US006247411B1

(12) United States Patent
Vornfett

(10) Patent No.: US 6,247,411 B1
(45) Date of Patent: Jun. 19, 2001

(54) ELECTRIC CONTACT ASSEMBLY FOR A CARTRIDGE TO BE FIRED FROM A WEAPON BARREL

(75) Inventor: Karl-Ulrich Vornfett, Unterlüss (DE)

(73) Assignee: TZN Forschungs- und Entwicklungszentrum, Unterlüss (DE)

( * ) Notice: Subject to any disclaimer, the term of this patent is extended or adjusted under 35 U.S.C. 154(b) by 0 days.

(21) Appl. No.: 09/443,317

(22) Filed: Nov. 19, 1999

(30) Foreign Application Priority Data

Nov. 19, 1998 (DE) ..... 198 53 291

(51) Int. Cl.[7] ..... F42B 5/26

(52) U.S. Cl. ..... 102/472; 102/469; 102/470; 102/472

(58) Field of Search ..... 102/469, 470, 102/472

(56) References Cited

U.S. PATENT DOCUMENTS 3,009,419 * 11/1961 Clay, Jr. et al. ..... 102/472
5,421,264 * 6/1995 Petrick ..... 102/472
6,131,519 * 10/2000 Thiesen et al. ..... 102/469

FOREIGN PATENT DOCUMENTS

0729372-A1 * 5/1955 (GB) ..... 102/472

* cited by examiner

*Primary Examiner*—Michael J. Carone
*Assistant Examiner*—Lulit Semunegus
(74) *Attorney, Agent, or Firm*—Venable; Gabor J. Kelemen

(57) ABSTRACT

An electric contact assembly in combination with a cartridge to be fired from a weapon barrel. The cartridge has a cartridge case including a metal bottom having an externally exposed outer face; and an electronic unit disposed in the cartridge case. The electric contact assembly includes a contact arrangement for establishing an electric connection between the electronic unit and an evaluating and control apparatus situated externally of the cartridge. The contact arrangement includes a contact ring disposed in the case bottom and surrounds the longitudinal axis of the cartridge. The contact ring has an outer face which is approximately flush with the outer face of the case bottom. An insulation electrically insulates the contact ring from the case bottom. A magnetic field sensor emits a signal upon closing a breechblock of the weapon in which the cartridge is positioned. A switch is connected between the electronic unit and the contact ring. The switch has an open state in which electric connection between the contact ring and the electronic unit is interrupted and a closed state in which electric connection between the contact ring and the electronic unit is maintained. The magnetic field sensor is connected to the switch for placing the switch into the closed state solely in response to the signal emitted by the magnetic field sensor.

3 Claims, 2 Drawing Sheets

ELECTRIC CONTACT ASSEMBLY FOR A CARTRIDGE TO BE FIRED FROM A WEAPON BARREL

CROSS REFERENCE TO RELATED APPLICATION

This application claims the priority of German Application No. 198 53 291.1 filed Nov. 19, 1998, which is incorporated herein by reference.

BACKGROUND OF THE INVENTION

This invention relates to a cartridge which is adapted to be fired from a large-caliber weapon and is of the type which has a cartridge case accommodating at least one electronic unit. The cartridge case has a metal bottom in which a contact is disposed in an electrically insulated manner. The contact provides for an electric connection between the electronic unit or units within the cartridge case and an electronic evaluating and control device of the weapon, situated externally of the cartridge. The electronic units may be, for example, humidity and/or temperature sensors as well as memory units in which data characterizing the ammunition are stored, while the electronic evaluating and control device may be, for example, a fire control computer.

In cartridges of the above-outlined known type the connection between the electronic evaluating and control device and the electronic units disposed in the cartridge case is effected by the primer housing disposed in an insulated manner in the case bottom and by the case bottom electrically contacting the grounded weapon tube.

It is a disadvantage of the above-outlined cartridges that the electronic units within the cartridge (for example, the electronic igniter circuit) may be activated via the contacts even when the cartridge is not in the weapon tube. Further, the contacting and current conducting through the primer housing is relatively complex and frequently the primer housing does not provide for a reliable contacting.

SUMMARY OF THE INVENTION

It is an object of the invention to provide an improved cartridge of the above-outlined type in which a contacting between the electronic evaluating and control device and the electronic units situated in the cartridge case may be effected in a simple and operationally reliable manner.

This object and others to become apparent as the specification progresses, are accomplished by the invention, according to which, briefly stated, the electric contact assembly is combined with a cartridge to be fired from a weapon barrel. The cartridge has a cartridge case including a metal bottom having an externally exposed outer face; and an electronic unit disposed in the cartridge case. The electric contact assembly includes a contact arrangement for establishing an electric connection between the electronic unit and an evaluating and control apparatus situated externally of the cartridge. The contact arrangement includes a contact ring disposed in the case bottom and surrounds the longitudinal axis of the cartridge. The contact ring has an outer face which is approximately flush with the outer face of the case bottom. An insulation electrically insulates the contact ring from the case bottom. A magnetic field sensor emits a signal upon closing a breechblock of the weapon in which the cartridge is positioned. A switch is connected between the electronic unit and the contact ring. The switch has an open state in which electric connection between the contact ring and the electronic unit is interrupted and a closed state in which electric connection between the contact ring and the electronic unit is maintained. The magnetic field sensor is connected to the switch for placing the switch into the closed state solely in response to the signal emitted by the magnetic field sensor.

The invention is essentially based on the principle that instead of providing an electric contact via the primer housing of the cartridge, a separate contact ring is utilized which is accessible from the outside. To prevent an unauthorized manipulation of the electronic units within the cartridge via the contact ring, a switching device is provided which connects the electronic units within the cartridge case with the evaluating and control device of the weapon and which is further coupled with a magnetic field sensor disposed in or on the cartridge case bottom.

In the unloaded state of the weapon the contact ring of the cartridge is not connected with the electronic unit (or units) situated in the cartridge case, so that any manipulation with the contact ring has no effect on the electronic units. If, on the other hand, the cartridge is situated in the weapon barrel and the breechblock is closed, the magnetic field sensor emits a switching signal which causes the switching device to be closed and thus the electronic units are connected with the evaluating and control device of the weapon.

According to an advantageous feature of the invention the magnetic field sensor is arranged directly at the contact ring and the switching device is situated in the cartridge case.

DESCRIPTION OF THE PREFERRED EMBODIMENT

Figure 1:
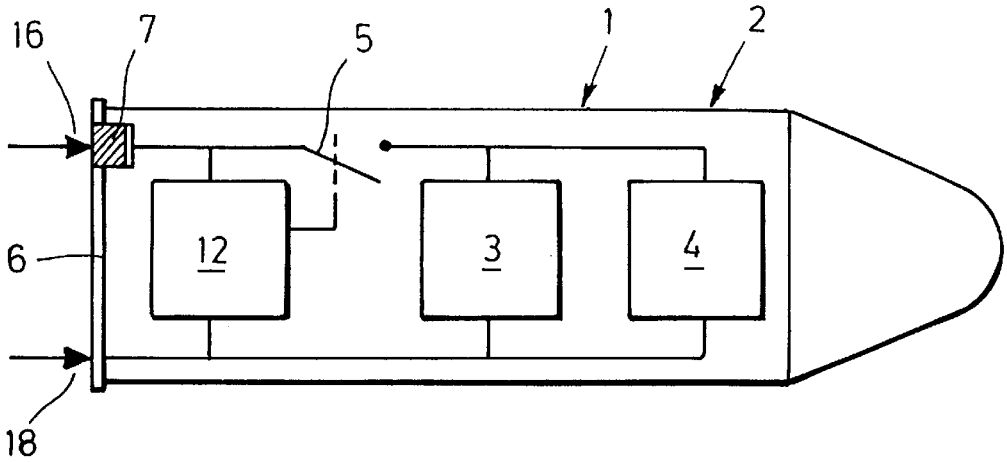
FIG. 1 is a schematic side elevational view, with block diagram, of a cartridge according to a preferred embodiment of the invention.

FIG. 1 shows a cartridge to be fired, for example, from a tank weapon. The cartridge has a cartridge case 2 in which two electronic units 3 and 4 are disposed. One of such units may be, for example, an electronic assembly for determining the humidity and temperature of the propellant powder while the other electronic unit may be an electronic primer circuit. The two units 3 and 4 are connected by a mechanical or electronic switching device 5 with a contact ring 7 disposed in the bottom 6 of the cartridge case 2.

Figure 2:
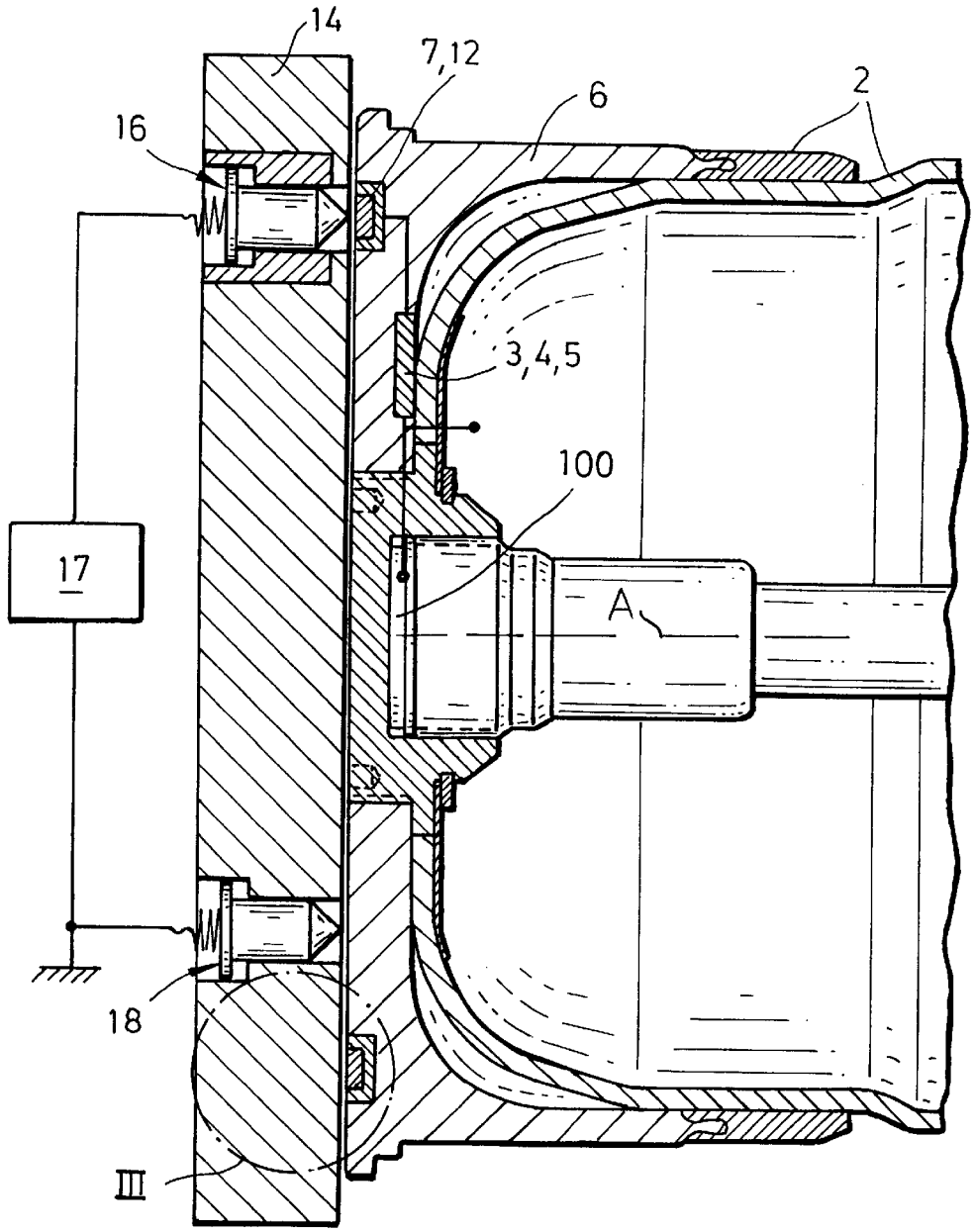
FIG. 2 is an axial sectional view of the case bottom region of the cartridge incorporating the invention and a breechblock in a face-to-face relationship with the case bottom.

As illustrated in FIG. 2, the electronic units 3 and 4 as well as the switching device 5 may be constituted by chips and may be supported in a suitable recess of the case bottom 6 and may be connected with the primer 100 of the cartridge 1.

Figure 3:
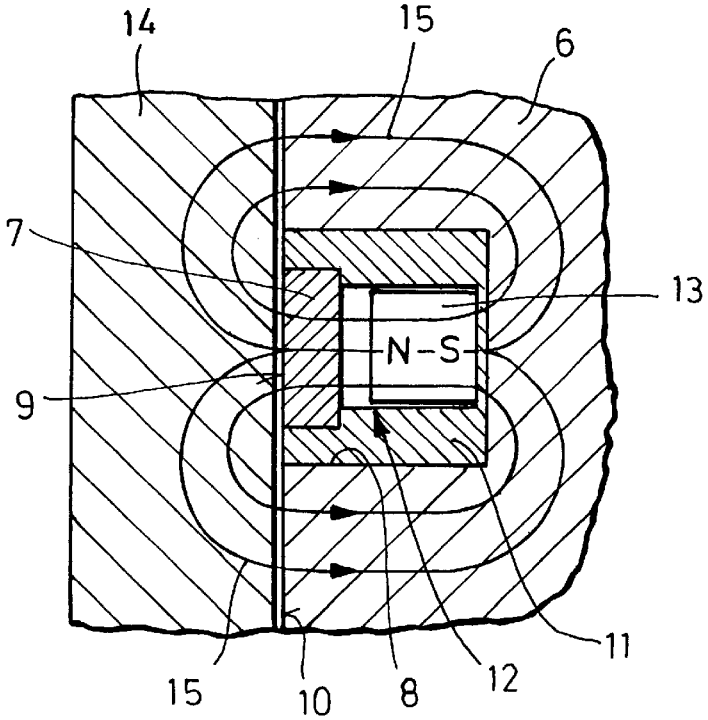
FIG. 3 is an enlarged view of the inset III of FIG. 2.

Also referring to FIG. 3, the contact ring 7 is positioned in a groove 8 of the case bottom 6 in such a manner that its outwardly oriented face 9 extends up to (that is, at least approximately flush with) the outer face 10 of the case bottom 6. Further, the contact ring 7 is electrically insulated from the metal bottom 6 by an insulator thimble 11. A magnetic field sensor 12, together with an integrated magnet 13, is arranged in the groove 8 at that side of the contact ring 7 which is opposite from the ring face 9.

The switching device 5 is open when the cartridge is not positioned in the weapon barrel, for example, when the cartridge 1 is in storage or in transport. In the open state of the switching device 5 no electric connection exists between the contact ring 7 and the electronic units 3 and 4.

If, on the other hand, the cartridge 1 is positioned in a weapon barrel and the breechblock 14 of the weapon is closed, the magnetic field sensor 12 emits a switching signal, because by virtue of the closing of the breechblock 14 which is of a magnetically conducting material (steel), the magnetic circuit for the field sensor 12 is closed. This is illustrated in FIG. 3 by the magnetic field lines 15. The switching signal actuates the switching device 5 which electrically connects the electronic units 3 with the contact ring 7.

Turning once again to FIG. 2, when the breechblock 14 is in its shown closed position, the contact ring 7 is electrically contacted by a first contact member 16 which is supported in and electrically insulated from the breechblock 14 and is displaceable parallel to the longitudinal axis of the weapon tube. The contact piece 16 is connected with the evaluating and control device 17 (such as a fire control equipment).

In the described embodiment a second electric connection is effected by the ground. For this purpose the evaluating and control apparatus 17 is coupled to a second contact member 18 which too, is displaceable parallel to the longitudinal axis of the weapon tube but which is not insulated electrically from the breechblock 14.

It is to be understood that the invention is not limited to the above-described example. Thus, for example, the closed breechblock may be also detected by two or more magnetic field sensors situated in the cartridge case bottom. The magnetic field sensors need not necessarily be situated in the bottom groove for the contact ring but may be arranged in a separate recesses.

Further, the switching device 5 need not necessarily be situated in the cartridge case itself but may be part of the evaluating and control apparatus, located externally of the cartridge. In such an embodiment, however, as a rule, an additional connection between the cartridge and the evaluating and control device would be required which then would be connected with an additional contact ring.

If required, as the second electric connection between the cartridge and the evaluating and control apparatus an electrically insulated conductor may be used instead of ground. In such an arrangement the contact member 18 is configured similarly to the contact member 16 and is disposed in the region of the case bottom which contacts such a contact member.

It will be understood that the above description of the present invention is susceptible to various modifications, changes and adaptations, and the same are intended to be comprehended within the meaning and range of equivalents of the appended claims.

What is claimed is:

1. An electric contact assembly in combination with a cartridge to be fired from a weapon barrel; said cartridge comprising (a) a longitudinal axis;

(b) a cartridge case including a metal bottom having an externally exposed outer face; and (c) an electronic unit disposed in said cartridge case; said electric contact assembly comprising (a) a contact arrangement for establishing an electric connection between said electronic unit and an evaluating and control apparatus situated externally of said cartridge; said contact arrangement including (1) a contact ring disposed in said bottom and surrounding said axis; said contact ring having an outer face being approximately flush with said outer face of said bottom; and (2) an insulation electrically insulating said contact ring from said bottom;

(b) a magnetic field sensor for emitting a signal upon closing a breechblock of the weapon in which the cartridge is positioned; and (c) a switch connected between said electronic unit and said contact ring and having an open state in which electric connection between said contact ring and said electronic unit is interrupted and a closed state in which electric connection between said contact ring and said electronic unit is maintained; said magnetic field sensor being connected to said switch for placing said switch into said closed state solely in response to said signal.

2. The electric contact assembly as defined in claim 1, further comprising a groove provided in said outer face of said bottom; said contact ring and said magnetic field sensor being positioned in said groove.

3. The electric contact assembly as defined in claim 1, wherein said switch is disposed in said cartridge case.

* * * * *